United States Patent [19]

Jäeger

[11] Patent Number: 4,756,428

[45] Date of Patent: Jul. 12, 1988

[54] METHOD AND TURBO-SEPARATOR FOR DISPERSION AIR SEPARATION, PARTICULARLY OF CEMENT

[75] Inventor: Heinz Jäeger, Bochum, Fed. Rep. of Germany

[73] Assignee: Klockner-Humboldt-Deutz Aktiengesellschaft, Fed. Rep. of Germany

[21] Appl. No.: 873,494

[22] Filed: Jun. 12, 1986

[30] Foreign Application Priority Data

Jun. 15, 1985 [DE] Fed. Rep. of Germany ..... 3521638

[51] Int. Cl.[4] ..... B07B 4/02; B07B 11/06

[52] U.S. Cl. ..... 209/135; 209/145; 209/148; 209/154

[58] Field of Search ..... 209/134, 135, 145, 146, 209/148, 150, 153, 154

[56] References Cited

U.S. PATENT DOCUMENTS

| | | | |
|---|---|---|---|
| 226,808 | 4/1880 | Thompson et al. | 209/145 |
| 919,291 | 4/1909 | Moodie | 209/148 X |
| 1,512,687 | 10/1924 | Hellmers | 209/145 |
| 2,224,169 | 12/1940 | Turnbull | 209/145 X |
| 3,275,140 | 9/1966 | Rasmussen | 209/139.2 |
| 3,615,008 | 10/1971 | Alpha | 209/148 X |
| 4,296,864 | 10/1981 | Misaka et al. | 209/148 X |
| 4,551,241 | 11/1985 | Saverse et al. | 209/148 |
| 4,564,442 | 1/1986 | Jager | 209/148 |

FOREIGN PATENT DOCUMENTS

| | | | |
|---|---|---|---|
| 0038909 | 11/1981 | European Pat. Off. | 209/145 |
| 0152278 | 8/1985 | European Pat. Off. . | |
| 0145010 | 6/1902 | Fed. Rep. of Germany | 209/134 |
| 1130261 | 5/1962 | Fed. Rep. of Germany | 209/134 |
| 2617788 | 3/1978 | Fed. Rep. of Germany . | |
| 2909037 | 9/1980 | Fed. Rep. of Germany | 209/148 |
| 2580195 | 10/1986 | France | 209/145 |
| 0694558 | 7/1953 | United Kingdom . | |
| 1018020 | 1/1966 | United Kingdom . | |
| 1049306 | 11/1966 | United Kingdom . | |
| 2176426 | 12/1986 | United Kingdom | 209/148 |
| 1233963 | 5/1986 | U.S.S.R. | 209/134 |

*Primary Examiner*—Johnny D. Cherry
*Assistant Examiner*—Edward M. Wacyra
*Attorney, Agent, or Firm*—Hill, Van Santen, Steadman & Simpson

[57] ABSTRACT

A method and mechanism for the separation of materials from a stream of pulverulent material such as cement including a rotatable plate onto which the material is fed with the material being centrifugally discharged in a bell shaped flow pattern, a radially inwardly directed flow of air across the veil carrying fine materials inwardly through a rotatable distributor; and coaxial dip tubes centrally located for receiving the gradations of fine material passing gravitationally downwardly, with the coarse materials remaining outside of the distributor and being received in a downward flow.

14 Claims, 2 Drawing Sheets

METHOD AND TURBO-SEPARATOR FOR DISPERSION AIR SEPARATION, PARTICULARLY OF CEMENT

BACKGROUND OF THE INVENTION

The invention relates to improvements in method and apparatus for the separation of a materials stream such as cement to different gradations of fine through coarse grained fractions. More particularly, the invention employs a rotatable distributing plate to form an annular bell shaped veil of material with separating air passing inwardly to fractionally separate the material.

Dispersion air classifiers for separating pulverulent materials in a stream into a plurality of fractions have been known such as, for example, in German AS No. 26 17 788.

In accordance with classification devices utilized, the material to be classified is distributed by a rotatable circular distributing plate which throws off the material in a bell shaped veil, and separating air is passed through the material in a radially inwardly direction. The coarse material is slung outwardly due to centrifugal force and also being acted on by the force of gravity, falls down along an outside wall of a classifying chamber into a conically shaped lower part of the classifier.

The separating air which is passed radially inwardly is loaded with finer grain fractions and is conducted inwardly by means of concentrically arranged air deflecting baffles. Additionally, grain fractions are discharged by forces of mass inertia at the reversing locations of the air and are collected in annularly arranged air conveying channels in order to be discharged as separated according to grain size categories.

Such classifiers are disadvantageous particularly when they are to be suitable for separating different grain size categories. They require large volumes and involve large expensive apparatus so that the cost for the apparatus and conveying means is expensive.

Commercial practice dictates that cement plates frequently operate in a part-load range. Currently the number of new plants being erected is relatively small. Therefore, technological development is primarily directed toward the optimization of existing systems. The goal of this optimization is to be able to produce a larger qualitatively different spectrum of products in the same systems in different quantities at favorable costs and in such a manner as to also possibly increase the capacity of the plants. The accommodation of the requirements of final grinding is also a subject matter of such efforts. Particular attention is paid to circulation of the material within the mill in order to improve the performance of the classifiers.

Accordingly, an object of the present invention is to obtain a method of classifying and a design of classifier possible in a simple way and with the minimum shutdown time of a plant during modernization.

In accordance with the principles of the invention, the objects are achieved by providing a rotating plate which rotates on a vertical axis such that material distributed on the center of the plate is centrifugally discharged radially outwardly and with the combination of the centrifugal force and the force of gravity, a bell shaped material veil is provided. An annular radially inwardly directed flow of separating air is passed through the veil of materials and the discharge of the separating air which is loaded with the finer grain fraction emerges centrally and downwardly and the coarser material is collected in an annular outwardly located chamber. By this method, the size of the product bell shaped veil can be arbitrarily adapted to the desired classifying capacity. The method allows a relatively large material stream to be classified in an advantageously small space. Further, it allows the materials flow to be fashioned especially advantageously relative to utilization of the force of gravity. It has been found that the occurring pressure losses and energy consumption are surprisingly low. The divergence of the separating air located with the finer grained fraction passing radially inwardly in the direction of the classifier axis allows a separation of the fine grain fraction in, for example, cyclones positioned directly below the classifier. The flow routes thereby become relatively short so that this reduces the energy consumption of the process. Collecting the coarser materials in an annular outwardly located space permits the provision of an eccentric coarse materials discharge.

The required airstream for the classifier can be kept surprisingly low due to the bell shaped materials veil. Changes in the classifier airstream will have a less disadvantageous influence on the classifier performance than in heretofore known classifying methods.

In accordance with the principles of the invention, the classifying air which is directed in an inwardly flow through the bell shaped veil is divided into classifying air substreams. Different substreams are loaded with different gradation of fine grade compositions. This accomplishes a particularly beneficial multi-product classification. Moreover, uniform wear, particularly of a distributor which is utilized can be achieved.

In accordance with a further function of the invention, a uniform distribution of classifying air is provided over the bell shaped material veil. That is, the classifying air is uniformly distributed relative to the veil before it passes through the material veil and thus an advantageously sharply defined separation boundary of the classifier is obtained.

It is a further feature of the invention that the classifying air is deflected before passing through the material veil particularly with a deflection which is differentially adjustable for each substream of the classifying air. The from the separately discharged substreams of classifying air with the utilization of known separating methods such as cyclones.

Further in accordance with the invention, the discharge of the classifying air occurs on the same axis and in the same direction as to the admission of materials into the classifier. As a result, the system parts can be easily arranged coaxially one above the other. In some instances this permits re-equipping mill structures of existing systems which are often limited in ground area but provide for substantial height.

A further feature of the invention is that it employs a symmetrical division and guidance of the classifying air before it is passed through the materials bell shaped veil. The division of the classifying air and symmetrical guidance allows short routes of airflow and a very compact structure for the classifier. This also accomplishes a further measure for reducing operating costs.

A further factor of the invention is that coarser material is pneumatically discharged from a surrounding annular space by feeding secondary air which is important particularly for raw material having residual moisture. The coarse material is mechanically discharged. By avoidance of a sole gravity discharge of the coarse material, this leads to a further reduction of the overall necessary volume. Dry material can be advantageously discharged trouble-free in pneumatic fashion. It is better to mechanically discharge coarse material having residual moisture.

A further factor of the invention is that dust-laden air is supplied such as from a mill de-dusting. This arrangement advantageously allows the costs for the de-dusting of other system parts to be reduced. Auxiliary apparatus for de-dusting air arising from mill de-dusting are avoided. The dust particles present in the air are separated from the classifying air in a separating device which is already present.

A further factor of the invention exists in that the finer grained fractions are classified in concentric substreams of classifying air having a grain size increasing from the inside toward the outside. A multi-product classification can thereby be implemented utilizing the same principles. Dependent upon which streams of fine material are combined, the method can be easily adapted to different quality demands of the final product. The method opens up the flexibility of being able to react in an extremely flexible way to market requirements and changes.

It is a further feature of the invention that a cooling of the coarse material is undertaken by means of secondary air. The coarse material can be cooled in this process stage at the same time by the introduction of secondary air, particularly as a medium for pneumatically conveying the coarse material. A concentric arrangement of the conveying channel relative to the fine product discharge as an annular channel allows the coarse material to be cooled over a relatively long path and on an adequately large surface.

A dispersion air classifier may be used for the implementation of the method particularly for classifying cement, and this dispersion air classifier comprises a material admission means, a distributing plate with a drive which rotates the plate and distributes the material stream centrifugally off the plate edge to form a materials veil, a rotatable distributor, a feed aperture for classifying air, and a coarse materials discharge with at least one fine materials discharge as well as the classifier axis which is essentially vertical, that is in the direction of the earth's gravitational field so that thereby the materials admission and the fine materials discharge are arranged around the classifier axis, and a conveying channel is arranged around the fine materials discharge for the coarse materials discharge. The material distributed by the rotary plate is passed through the classifying air as a bell shaped generated veil or fog. The combination of the foregoing features provides a classifier with a high classifying performance which has a relatively advantageously low overall structure. The material paths are unusually short and the fine materials discharge are arranged coaxial with the classifier axis which allows separating cyclones to be used when desired and to be arranged directly below the classifier. As a result of the small structural volume, the classifier can also be easily integrated into existing old systems. Further, this arrangement contributes to the increase in capacity. The coarse material is not centrally discharged but is advantageously discharged from an outward location from an annularly arranged conveying channel coaxial with the classifier. The materials stream which is distributed to form a bell shaped generated mist surface exhibits a large area in comparison to other heretofore known classifiers so that this accomplishes a classifier with an unexpectedly high classsifying performance in comparison to its structural volume.

In accordance with the invention, the classifier uses at least one classifying air distribution channel which is annularly shaped with variable or diminishing cross-section and has an air admission aperture with the axis extending perpendicularly to the classifier axis. The classifying air distribution channel allows the air to symmetrically flow from the air admission aperture to the materials veil on a very short path. The symmetrical parts advantageously simplify the manufacture of the classifier.

It is a further feature of the invention that the air distribution channel includes air discharge apertures whose exit axis are parallel to the classifier axis and are arranged concentrically distributed around the classifier axis. A twist-free and very uniform air distribution derives in this way. Moreover, this arrangement of air admission into the classifying chamber allows an especially compact structure of the classifier since the classifying chamber and air distribution channel are arranged one above the other accomplishing advantageously low outside diameters of the classifier.

A further feature of the invention resides in that the classifying air distribution channel is arranged above the classifying chamber which is fashioned as a truncated cone tapering toward the bottom. This shaping of the classifying chamber allows dust-laden classifying air to be employed. Dust particles are presented with no opportunity of forming disturbing deposits in the classifying chamber.

In accordance with the construction of the apparatus, a hood is employed having a diameter which is smaller than or the same as the inside diameter of the classifying air distribution channel and which is attached with a relesable connection. This effects a further reduction in the structural volume of the classifier. The inside diameter of the classifier air distribution channel also functions as a hood wall. After the connection is released, the wear parts can be advantageously withdrawn toward the top in a simple way and serviced. The structure of the classifier employs a distributing plate, a drive and hood which are fashioned to form an interrelated assembly unit. The assembly and maintenance are thereby advantageously reduced and further, the availability of the classifier for servicing, is increased.

The distributing plate employs a hollow drive shaft in which a conduit for the admission of the materials stream is arranged. The materials stream admission is thus designed in a particularly trouble-free way. Blockages within the admission conduit which sometimes occur with angled conduits are avoided and the wear is reduced. The seating of the distribution plate and of the distributor can be dimensioned large in an advantageous way.

Another factor of the invention is the drive which uses a gearing having a hollow shaft that is arranged to receive the materials stream admission and which has a wall that is coolable. Another even more compact structure of the classifier uses a gearing fashioned in this matter. The cooling design of the hollow shaft avoids injurious influence of the materials temperature on the transmission oil.

The structure of the invention utilizes one or more dip pipes or tubes coaxial with the classifier. For the separation of a plurality of grades of fines, a plurality of concentric tubes are employed and the fine material can flow directly down the individual tubes into collection apparatus for receiving the separated fine material. This effects a saving in machine size and capital costs.

The tubes employ classifying air dividing plates which extend radially horizontally and are concentrically arranged around the tubes with each tube having an air dividing plate attached to it and being adjustable in height. With the assistance of the tubes and the air dividing plates, the charging of air into the mechanism can be influenced. Wear of the distributor can be made uniform so that the maintenance intervals are lengthened. This feature contributes to the availability of the classifier. When the classifying air substreams are discharged downwardly separately into different tubes, a multi-product classification is possible with the same classifier thus permitting the dividing of the input materials stream into different grain size ranges. A parallel operation of a plurality of classifiers having different separating boundaries for the multi-product classification is not necessary. Overly involved structural engineering measures for multi-product classification are avoided.

In accordance with the invention which employs air, deflection and distribution elements in the classifying chamber, a vane ring is provided which is separately adjustable from the outside for each classifying air part. The management of the air flow and distribution of classifying air can be influenced by the integration of air, deflection and distribution profiles in the classifying chamber. The adjustment of these profiles can be fashioned with a vane ring of a type heretofore known which allows the separating boundary of the classifier to be adapted as desired. The separate adjustment of the vane ring for each substream of classifying air is advantageous in multi-product classification. The composition of the individual grain size ranges in the fine material can thereby be controlled. It is contemplated that for the removal of coarse material a mechanical conveyor may be employed such as a scraper flight conveyor utilizing clearing paddles. Pneumatic discharge of the coarse material becomes difficult if the material has residual moisture. A mechanical conveyor can be employed obtaining particular advantage with such material. Scraper flight conveyors which operate without a slope further advantageously reduce the overall height of the classifier. Clearing paddles can be structurally united with the distributor in a simple way. With rapid running of the distributor, the coarse material is again hurled into the classifying airstream by the clearing paddles and the classification favorably influenced.

The classifier employs an air conveyor channel having slopes down to a coarse materials discharge. Air conveying channels are operationally reliable particularly in systems for the manufacture of cement. The introduced secondary air can be simultaneously used for cooling the discharged coarse material. However, air from the de-dusting circulations can also be employed as secondary air so that existing de-dusting systems are used to a lesser degree and need not be provided in given new systems. The structure can be provided with blow-off jets for the distributor. Layers of fine material which have built up can be removed from the distributor in a particularly easy and efficient way. These jets can be combined with the paddles of the distributor which results in the pneumatic removal of layers of fine material. A quiet running of the distributor is achieved over long operating times.

Further objects, advantages and features will become more apparent with the teaching of the principles of the invention in connection with the disclosure of the preferred embodiment thereof in the following specification, claims and drawing, in which:

DESCRIPTION OF THE PREFERRED EMBODIMENTS

Figure 1:
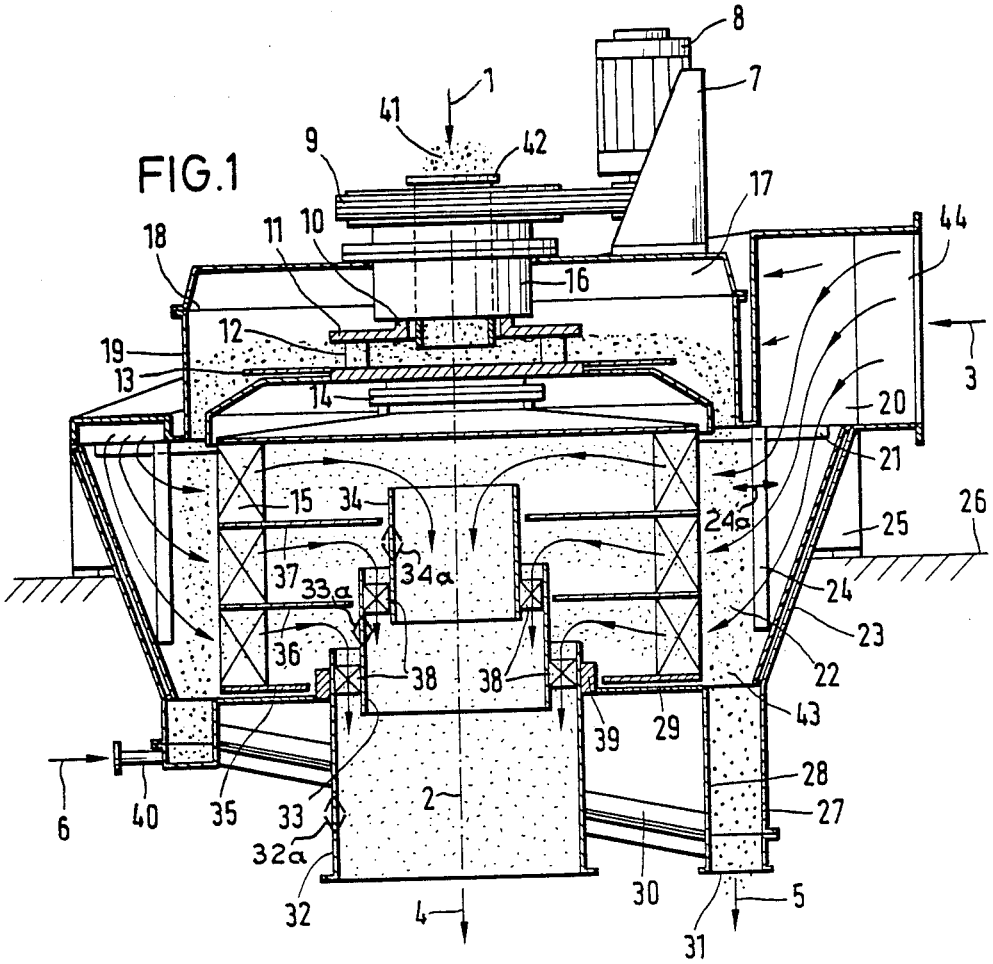
FIG. 1 is a somewhat schematic vertical sectional view with a section taken through the axis of a separator embodying the principles of the present invention.

As illustrated in FIG. 1, an arrow 1 indicates the direction in which a materials stream of pulverulent material is supplied to a classifier such as through conduits with appropriate delivery structure. The direction of delivery of the product is along the axis 2 of the classifier.

An arrow 3 indicates a direction of air supply to the classifier and suitable air supply devices are provided with a blower and flow and pressure control. An arrow 4 indicates where the finer grain fraction of classified material is delivered after being separated within the classifier. As will later become apparent herein, the classifier may be arranged to separate gradations of fine materials with each of the three dip tubes shown at 32, 33 and 34 delivering a different grade of fine grain fraction and suitable receiving means are provided to receive the fines which are delivered in the direction of the arrow 4.

The arrow 5 indicates the direction of delivery of the coarse material discharge and suitable equipment will be provided for carrying away the coarse material. In a preferred form, a mechanical conveyor such as a scraper flight conveyor having clearing paddles may be employed. These paddles would be located upwardly near the distributor 15.

Rotary parts rotating about the axis 2 are driven by a motor 8 mounted on the framework 7. The motor is provided with pulley and sheave arrangements connected to drive a hollow shaft 10 by V-belts 9 trained over pulleys on the motor and on the hollow shaft. The shaft 10 includes a flange 11 which is connected to a rotary distributing plate 13 by means of individual circumferentially spaced connecting spacer elements 12. The distributing plate has a circular upwardly facing surface for distributing material deposited thereon by centrifugal force. A further distributor 15 is driven with the distributing plate by a flange connection 14. The hollow shaft 10 is seated within a bearing member 16. The bearing housing is supported on a classifier hood 17 by a flange. The upper part of the classifier hood can be lifted at a partition line 18 off of the cylindrical part of the hood 19.

Classifying air flows into a classifying air distribution channel 20 being supplied in the direction indicated by the arrow 3 and flowing into the classifier through a conduit connection 21. 21 has a plurality of air discharged apertures which are distributed concentrically and spaced circumferentially, being concentric to the axis of the classifier 2. The apertures are located in the lower annular surface of the member 21.

The classifier housing 23 is shaped in the fashion of a truncated cone diminishing in diameter in a downward direction. Air baffle elements 24 are arranged in the classifying chamber 22 and these air baffle elements 24 conduct the entering classifying air in the desired direction toward the center of the classifier depending upon their design. It is also contemplated that the baffle elements may be constructed so as to be adjustable so that a desired modification of the airflow can be accomplished by setting the adjusted position of the baffles and locking them in such position and an adjustment mechanism is shown schematically by an arrowed line 24*a*.

As the flow of material enters the classifier, it is thrown off of the rotating plate 13 in a bell shaped pattern to form a fog or veil of material. The coarse material is collected between two concentric cylindrical surfaces 27 and 28. The outer surface 27 attaches to and forms a continuation of the lower end of the classifier housing 23. The inner cylindrical surface 28 extends downwardly from the outer diameter of the distributor 15. A plate 29 forms the floor of the classifier. The surfaces 27 and 28 are obliquely cut, that is, at a downwardly extending angle so that an annular channel having a slope is formed extending down to a discharge opening 31 for the coarse material.

The fine materials discharge is formed by three dip tubes 32, 33 and 34 arranged concentrically and of decreasing diameter with the tube 32 having the largest diameter, and the tube 34 having the smallest diameter. Connected to the tubes are horizontal annular plates 35, 36 and 37 which are secured adjacent the upper end of each of the tubes. These dividing plates are secured at the outer edge to the distributor 15. The tubes are connected to each other by spacers 38 which are circumferentially spaced so as to not impede the flow of fine material into the upper end of the tubes but to fixedly position the three tubes in a coaxial relationship. Further, adjusting elements are provided shown schematically by the arrowed lines 32*a*, 33*a* and 34*a* which allow for the vertical adjustment of the tubes to thereby aid in selectively controlling the classification of fines which are fed into the upper ends of the tubes. The tubes may feed into a common space for the fine materials to flow downwardly as shown by the arrowed line 4 or separate connectors may be provided so that the three classification fines are kept separate and are fed away from the classifier separately.

An air conveying channel 30 includes a connection piece 40 through which a secondary air is provided for aiding in the conveyance of coarse material and with the flow of air provided at 6, the coarse material is aided in flowing downwardly to the exit shown by the arrowed line 5.

Figure 2:
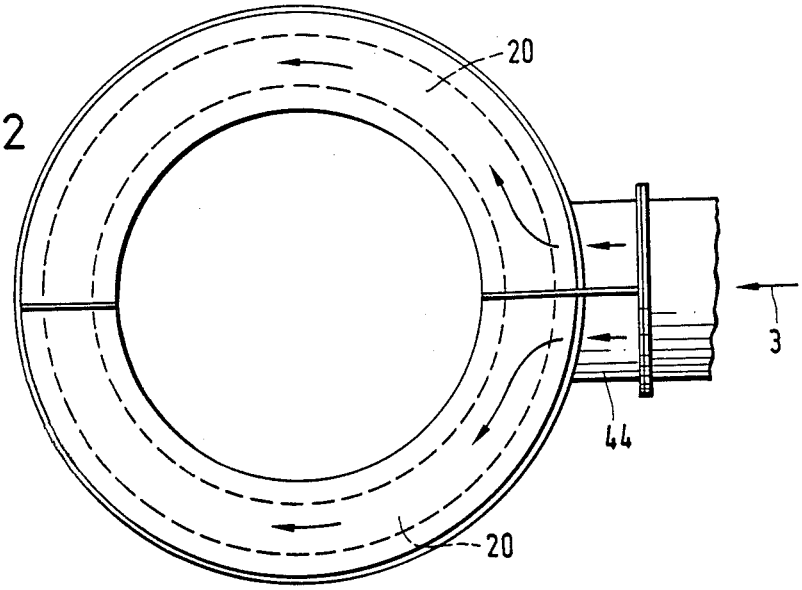
FIG. 2 is a schematic plan view illustrating the operation of the air distribution channel.

FIG. 2 shows schematically an air distribution or air flow pattern. The classifying air is blown in as shown by the arrowed line 3 and the air admission aperture 44 may be divided so that the air flows in opposite circumferential directions. This is provided by the channels 20 having the divider therebetween so that the air is distributed in both circumferential directions.

Figure 3:
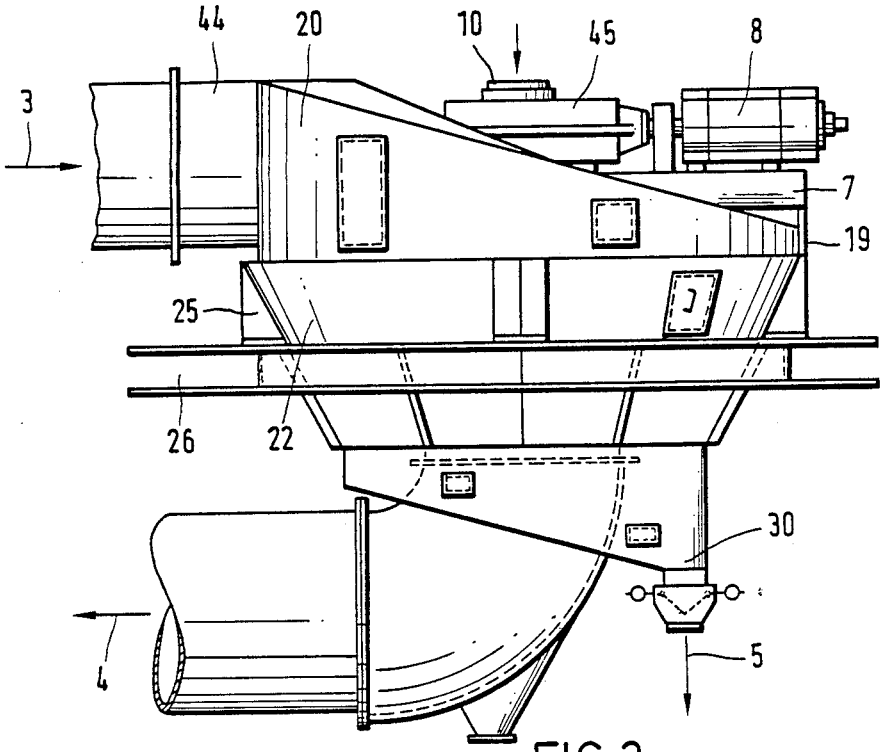
FIG. 3 is an outside elevational view of the classifier.

FIG. 3 illustrates the external appearance of the classifier from a side view. FIG. 3 also shows an alternative drive arrangement wherein a motor 8 drives the hollow shaft of the classifier by means of a reducing gearing 45. Similar parts are numbered similarly in FIG. 3 corresponding to their appearance and location in FIG. 1.

Figure 4:
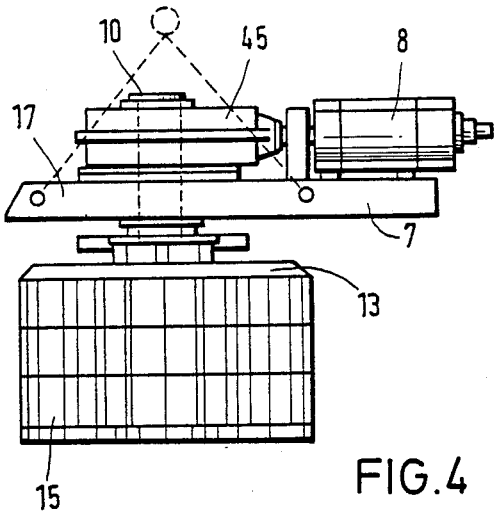
FIG. 4 is a fragmentary view of portions of the classifier.

FIG. 4 illustrates the internal parts lifted out of the housing of the classifier. The distributor 15 is rigidly connected to the distributor plate 13 and carried by the classifier hood 17. The drive is provided by the motor 8 mounted on the hood 7 so that rotational driving movement is provided through the gearing 45 to the hollow shaft 10. This figure illustrates the operation when maintenance is required and the entire assembly can be lifted out for cleaning, servicing or for being replaced as a whole. The structural arrangement provides for a low structural height which has not heretofore been possible. Thus, the free space above the classifier required for servicing and replacement can be low. After the entire assembly has been removed and serviced, it is replaced and maintenance can be accomplished with a minimum of shut-down time.

In operation a stream of pulverulent material 41 is directed to the classifier through the conduit 42 onto the rotationally driven distributing plate 13. The distributing plate 13 radially accelerates the material stream and uniformly distibutes it to form a bell shaped mist. The materials are distributed in a planar descending pattern within the cylindrical part 19 of the classifier hood and a bell shaped materials stream veil passes downwardly concentric to the classifier axis 2 drawn down by gravity.

Classifying air flows radially inwardly through 360° from the direction indicated by the arrowed line 3 into the classifying air distribution channel 20 and is distributed. The classifying air distribution channel deflects the air through the discharge apertures 21. The air is again deflected into the classifying chamber 22 through the operation of the air baffle elements 24. Air thus passes inwardly through the veil of descending material through the distributor to carry the fine material into the three strata as indicated by the arrowed lines to enter the spaces above plates 37, 36 and 35 and to be received by the upper ends of the tubes 34, 33 and 32. The classification is such that the finer grained lighter materials are first removed above the upper plate 37 and successively less fine grains are removed above the succeeding plates 36 and 35. The entire assembly rotates, that is, the distributor plate 13, the distributor 15, the plates 37, 36 and 35, and the tubes are all driven in rotation by the motor. The distributor 15 includes a plurality of vertical circumferentially separated plates between which the material passes and the plates can be set at an angle to augment the flow of fine materials. Control of the separation can thus be coordinated and augmented by the vertical setting of the tubes 32, 33 and 35, by the amount and flow of the air entering at 3, and by the setting of the baffles 24, as well as the adjustment and setting of the plates which are part of the distributor 15.

In the event the separation involves only a separation of coarse and fine material, only one dip pipe such as 32 need be provided.

Thus, it will be seen that I have provided a classifier which meets the objectives and advantages above set forth and which attain a controllable and uniquely efficient classifier.

I claim as my invention:

1. A method for the separation of a material stream of pulverulent material such as cement into different fine through coarse fractions comprising the steps:

distributing a flow of pulverulent material in an annular pattern thrown out radially from a rotating disk to move vertically downwardly due to gravity so as to form a bell shaped flow pattern and form a veil of material;

passing a classify asir flow through said veil in a direction from the outside to the inside;

removing said classifying air with entrained fine material centrally in a downward direction assisted by gravity;

collecting and removing coarser materials annularly outside of the removal of said fine material; and dividing said air flow into substreams passing through different areas of said flow pattern for removing substreams of classifying air separately with separate fractions of separated fine material.

2. A method for the separation of a material stream of pulverulent material such as cement into different fine through coarse fractions comprising the steps:

distributing a flow of pulverulent material in an annular pattern thrown out radially from a rotating disk to move vertically downwardly due to gravity so as to form a bell shaped flow pattern and form a veil of material;

passing a classifying air flow through said veil a direction from the outside to the inside;

removing said classifying air with entrained fine material centrally in a downward direction assisted by gravity;

collecting and removing coarser materials annularly outside of the removal of said fine material; and dividing said air flow into substreams passing through different areas of said flow pattern, said substreams of classifying air being arranged to separate grain fractions having a grain size increasing from the center radially outwardly.

3. A mechanism for the separation of materials from a stream of pulverulent material such as cement and the classification into different fine through coarse fractions comprising in combination:

a horizontally disposed distributor plate mounted for rotation on a vertical axis and adapted to receive pulverulent material to be separated into fractions and to centrifugally discharge off the surface of the plate to distribute the materials into a bell shaped flow pattern to form a veil of material;

an outer chamber for receiving the veil of material;

means for directing an annular radially inwardly directed flow of air through said veil for transporting fine materials inwardly;

a rotatable distributor below said plate receiving the flow of air and fine material passing inwardly;

a plurality of coaxial centrally located vertical tubes of different diameters receiving gradation of fines carried with said air through the veil of material;

and means for receiving the coarse material passing gravitationally downwardly outside of said distributor.

4. A mechanism for the separation of materials from a stream of pulverulent material such as cement in the classification into different fine through coarse fractions constructed in accordance with claim 3:

wherein said vertical tubes are positioned with their upper ends at different vertical heights.

5. A mechanism for the separation of materials from a stream of pulverulent material such as cement in the classification into different fine through coarse fractions constructed in accordance with claim 4:

wherein said vertical heights are arranged so that the radially innermost tube is higher than tubes outwardly thereof.

6. A mechanism for the separation of materials from a stream of pulverulent material such as cement in the classification into different fine through coarse fractions constructed in accordance with claim 3:

wherein said means for directing the annular radially inwardly directed flow of air is constructed to distribute the flow uniformly annularly.

7. A mechanism for the separation of materials from a stream of pulverulent material such as cement in the classification into different fine through coarse fractions constructed in accordance with claim 3:

including means for adjusting the path of said inwardly directed flow of air into different substreams.

8. A mechanism for the separation of materials from a stream of pulverulent material such as cement in the classification into different fine through coarse fractions constructed in accordance with claim 3:

including means for delivering the flow of pulverulent material from the distributor plate axially downwardly before distrbuting the flow.

9. A mechanism for the separation of materials from a stream of pulverulent material such as cement in the classification into different fine through coarse fractions constructed in accordance with claim 3:

wherein the means for directing the angular radially inwardly directed flow of air is constructed to arrange the classifying air flow uniformly around said veil.

10. A mechanism for the separation of materials from a stream of pulverulent material such as cement in the classification into different fine through coarse fractions constructed in accordance with claim 3:

including means for supplying a secondary air and removing the coarse material with the secondary air.

11. A mechanism for the separation of materials from a stream of pulverulent material such as cement in the classification into different fine through coarse fractions constructed in accordance with claim 3:

wherein the means for directing an annular radially inwardly directed flow of air of diminishing cross-section in a downward direction.

12. A mechanism for the separation of materials from a stream of pulverulent material such as cement in the classification into different fine through coarse fractions constructed in accordance with claim 3:

including a rotary distributor connected to rotate with the plate.

13. A mechansim for the separation of materials from a stream of pulverulent material such as cement in the classification into different fine through coarse fractions constructed in accordance with claim 3:

including a hollow shaft coaxial with the plate axis and conducting pulverulent material to the plate.

14. A mechanism for the separation of materials from a stream of pulverulent material such as cement in the classification into different fine through coarse fractions constructed in accordance with claim 3:

including distribution baffles positioned to control the flow of air inwardly across said veil.

* * * * *